US011547215B2

(12) United States Patent
Branscomb et al.

(10) Patent No.: US 11,547,215 B2
(45) Date of Patent: Jan. 10, 2023

(54) FOOTREST DEVICE

(71) Applicant: 3M INNOVATIVE PROPERTIES COMPANY, St. Paul, MN (US)

(72) Inventors: Matt R. Branscomb, Lakeville, MN (US); Jacob T. Lusson, Richfield, MN (US); Susan M. Butzer, Eagan, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 17/443,499

(22) Filed: Jul. 27, 2021

(65) Prior Publication Data

US 2022/0031080 A1 Feb. 3, 2022

Related U.S. Application Data

(60) Provisional application No. 63/058,149, filed on Jul. 29, 2020.

(51) Int. Cl.
*A47C 16/02* (2006.01)

(52) U.S. Cl.
CPC ..... *A47C 16/025* (2013.01)

(58) Field of Classification Search
CPC ... A47C 16/02; A47C 16/025; A63B 23/0458; A63B 2023/006; A63B 69/0093; A61H 2205/12
USPC ..... 297/423.39, 423.41, 423.43, 423.44
See application file for complete search history.

(56) References Cited

U.S. PATENT DOCUMENTS

| | | | | |
|---|---|---|---|---|
| 8,322,791 | B2 | 12/2012 | Port | |
| D725,925 | S | 4/2015 | Kaye | |
| 10,252,103 | B2 * | 4/2019 | Irwin | B32B 3/30 |
| 10,363,191 | B2 * | 7/2019 | Polonen | A63B 21/4035 |
| 2004/0210175 | A1 | 10/2004 | Robbins, III | |
| 2011/0269605 | A1 * | 11/2011 | Kim | A63B 22/14 482/121 |
| 2011/0316319 | A1 * | 12/2011 | Lukic | A47C 16/025 297/423.44 |

FOREIGN PATENT DOCUMENTS

| | | |
|---|---|---|
| CA | 2017814 | 11/1991 |
| CN | 103192752 | 7/2013 |
| DE | 4110586 | 10/1992 |
| FR | 2675359 | 10/1992 |

* cited by examiner

*Primary Examiner* — Sarah B McPartlin
(74) *Attorney, Agent, or Firm* — Vincent Pham

(57) ABSTRACT

A footrest device includes a base portion adapted to be switched between a first position and a second position. The base portion includes a first surface having a curved profile, wherein the first surface provides foot support to a user when the base portion is in the first position. The base portion also includes a second surface having a planar profile, wherein the second surface provides foot support to the user when the base portion is in the second position. The base portion further includes a pair of side surfaces extending between the first surface and the second surface, wherein at least one of the pair of side surfaces defines an indentation. The footrest device also includes at least one limit stop projecting from the first surface of the base portion, wherein the at least one limit stop is disposed proximate at least one of the pair of side surfaces.

17 Claims, 5 Drawing Sheets

FOOTREST DEVICE

TECHNICAL FIELD

The present disclosure relates to a footrest device for supporting feet of a user.

BACKGROUND

Workplace ergonomics is an area which has drawn much attention over the past few years. A common example involves a computer user who may have his/her arms at an ergonomically appropriate angle for using the computer to minimize chances of repetitive stress. Generally, users are presented with desks or tables at workplaces that are disposed at a pre-determined height from a floor. Further, a height-adjustable chair may be used to bring an upper body of the user into a proper relationship with the desk or table. Several chair manufacturers now incorporate mechanisms that allow a seat pan and a backrest of the chair to self-adjust and follow motions of the user. Such adjustments, however, do not take into consideration the relationship of the user to the floor. It is thus desirable to provide a footrest device to bring legs of the user into an ergonomically correct position to avoid problems such as leg strain, back strain, and/or circulatory problems.

Further, the footrest devices include a curved surface and a planar surface such that each of the curved surface and the planar surface may be embodied as foot supporting surfaces. Moreover, the footrest devices may be switched or flipped between the curved surface and the planar surface, based on user preference. Accordingly, the footrest device may include some means to switch the footrest devices between the curved surface and the planar surface. Conventional footrest devices include a complex mechanism for allowing flipping of the footrest devices between the curved surface and the planar surface. Further, the footrest devices also include multiple parts which may add to an overall weight and cost of the footrest device.

SUMMARY

Generally, the present disclosure relates to a footrest device. In view of the forgoing disclosure, there is a need for an improved footrest device that includes a robust and ergonomic design, is light in weight, and is simple to use. Accordingly, the footrest device described in the present disclosure includes a base portion having a pair of side surfaces. Each side surface includes an indentation. The indentations allows a user to flip the footrest device between a first position and a second position while sitting or standing thereby eliminating a requirement of leaning of the user. More particularly, users may use their toes or front portion of their foot to flip the footrest device between the first and second positions without lifting the footrest or leaning down. The footrest device also includes limit stops to restrict a range of movement of the base portion. Further, the footrest has been ergonomically designed to accommodate dimensions as per the ANSI/HFES 100-2007 standard approved by American National Standards Institute.

In an aspect of the present disclosure, a footrest device is provided. The footrest device includes a base portion adapted to be switched between a first position and a second position. The base portion includes a first surface having a curved profile, wherein the first surface provides foot support to a user when the base portion is in the first position. The base portion also includes a second surface having a planar profile, wherein the second surface provides foot support to the user when the base portion is in the second position. The base portion further includes a pair of side surfaces extending between the first surface and the second surface, wherein at least one of the pair of side surfaces defines an indentation. The footrest device also includes at least one limit stop projecting from the first surface of the base portion, wherein the at least one limit stop is disposed proximate at least one of the pair of side surfaces.

BRIEF DESCRIPTION OF THE DRAWINGS

Exemplary embodiments disclosed herein may be more completely understood in consideration of the following detailed description in connection with the following figures. The figures are not necessarily drawn to scale. Like numerals used in the figures refer to like components.

DETAILED DESCRIPTION

In the following description, reference is made to the accompanying figures that form a part thereof and in which various embodiments are shown by way of illustration. It is to be understood that other embodiments are contemplated and may be made without departing from the scope or spirit of the present disclosure. The following detailed description, therefore, is not to be taken in a limiting sense.

In the context of present disclosure, the terms "first", "second", "third", and "fourth" are used as identifiers. Therefore, such terms should not be construed as limiting of this disclosure. The terms "first", "second", "third", and "fourth" when used in conjunction with a feature or an element can be interchanged throughout the embodiments of this disclosure.

As mentioned above, conventional footrest devices include a complex mechanism for allowing flipping of the footrest devices between the curved surface and the planar surface. This is a problem because these devices, especially when they have multiple parts, add to the overall weight and cost of the footrest device and may break or malfunction which decreases the useful life of the footrest device. As a solution to one or more of these problems, the present disclosure relates to a footrest device having an ergonomically improved design. Further, the footrest device includes a robust design. The footrest device can be used in a first position and a second position based on a comfort of a user. The footrest device includes an indentation on each side surface of a base portion of the footrest device that allows switching of the footrest device between the first and second positions. Further, the user may switch the footrest device between the first and second positions while sitting or standing. Thus, a design of the footrest device described herein eliminates a need of leaning down or lifting the footrest device for switching the footrest device between the first and second positions. The footrest device does not include complex mechanisms for switching the footrest device between the first and second positions, thereby providing the footrest device that is light in weight and cost effective. Further, the footrest device includes limit stops to restrict a range of movement of the base portion when the footrest is in the second position. Further, the footrest device has been ergonomically designed to accommodate dimensions as per ANSI/HFES 100-2007 standard approved by American National Standards Institute.

Figure 1:
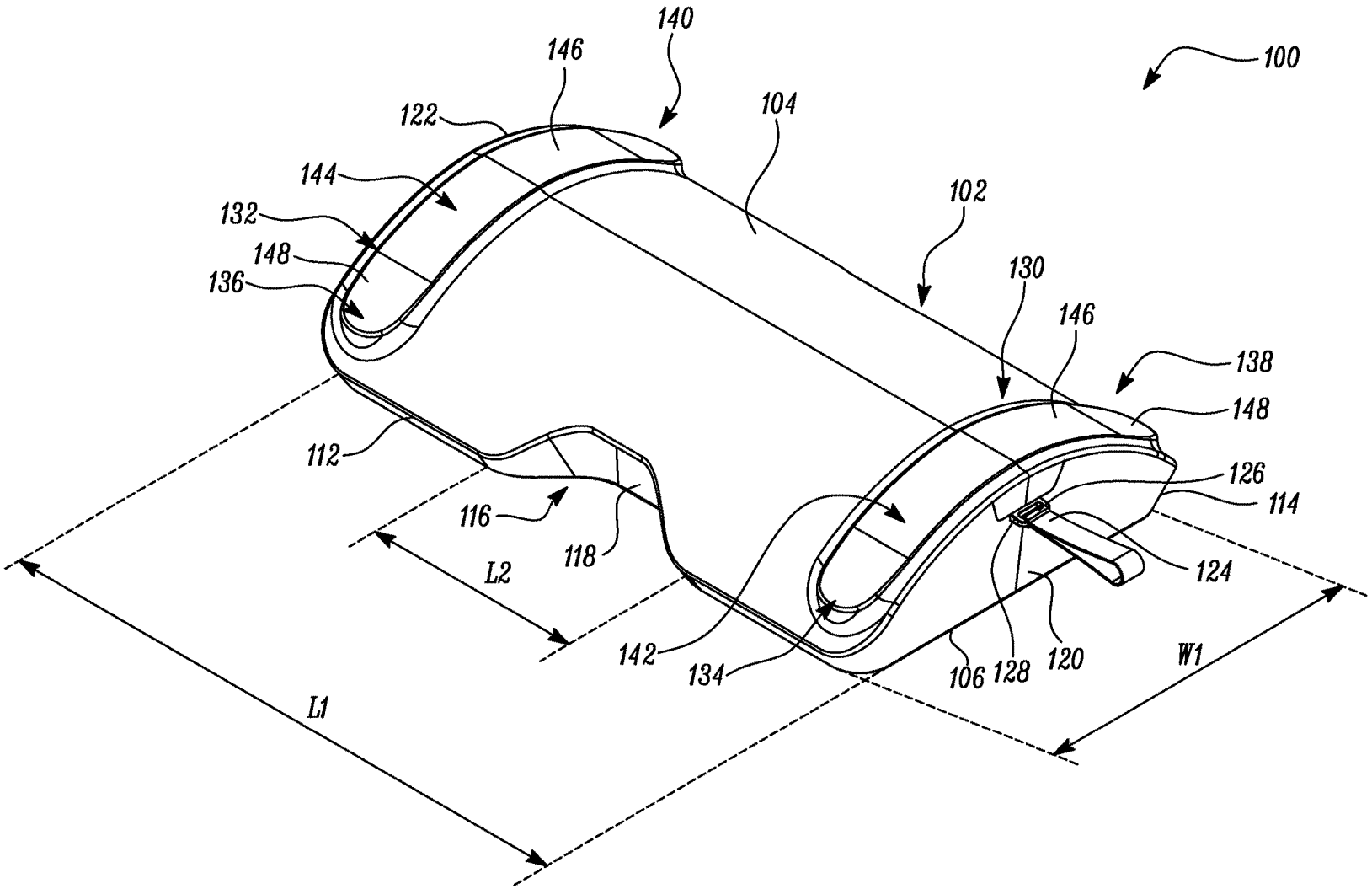
FIG. 1 is a perspective view of a footrest device in a first position according to an embodiment of the present disclosure.

FIG. 1 is a perspective view of a footrest device 100, according to one embodiment of the present disclosure. The footrest device 100 is designed to be used by users in a sitting position or a standing position. Further, the footrest device 100 can be used in a home environment or an office environment. The illustrated footrest device 100 is substantially rectangular in shape. In another embodiment, the footrest device 100 may have another shape. For example, the footrest device 100 may be square in shape. The footrest device 100 may be manufactured using a molding process. In one specific example, the footrest device 100 may be manufactured using a blow molding process. However, other molding processes, such as compression molding, extrusion molding, injection molding, powder metallurgy, and the like, may be used for manufacturing of the footrest device 100. The footrest device 100 may be manufactured using other manufacturing process as well, without any limitations.

The footrest device 100 includes a base portion 102 adapted to be switched between a first position and a second position. The base portion 102 may be manufactured using different types of materials depending upon cost, weight, durability, and other such factors. Generally, metals, polymers, ceramics, and composites may be used for manufacturing the base portion 102. The base portion 102 of the footrest device 100 defines a first width "W1" and a first length "L1".

The base portion 102 includes a first surface 104 having a curved profile. The first surface 104 provides foot support to a user when the base portion 102 is in the first position. FIG. 1 illustrates the base portion 102 in the first position where the curved first surface 104 is used as a foot supporting surface while the second surface 106 rests on a floor. A shape of the first surface 104 generally includes a convex shape. Further, the shape of the first surface 104 may be elliptical, parabolic, and the like. The base portion 102 also includes a second surface 106 having a planar profile. In one examples, the first and second surfaces 104, 106 may include a number of projections (not shown) that provide an improved grip to user foot or may be used to facilitate massage to user foot.

Further, the second surface 106 provides foot support to the user when the base portion 102 is in the second position. The base portion 102 is illustrated in the second position in FIGS. 2 and 5. In the second position, the planar second surface 106 is used as the foot supporting surface while the first surface 104 rests on the floor. Thus, each of the first surface 104 and the second surface 106 may be utilized as the foot supporting surfaces. Further, when the base portion 102 is in the second position, the footrest device 100 may allow a rocking motion between two ends of the first surface 104. It should be noted that the footrest device 100 may allow the rocking motion about an axis that is generally parallel to the first length "L1" of the base portion 102.

As shown in FIG. 1, the base portion 102 further includes a pair of side surfaces 112, 114 extending between the first surface 104 and the second surface 106. In the illustrated example, the pair of side surfaces 112, 114 includes the first side surface 112 and the second side surface 114. Each of the first and second side surfaces 112, 114 extend along the first length "L1" of the base portion 102.

Further, at least one of the pair of side surfaces 112, 114 includes an indentation 116. In the illustrated embodiment, each of the pair of side surfaces 112, 114 includes the indentation 116. Further, each indentation 116 in the pair of side surfaces 112, 114 have identical shape and dimensions. In another embodiment, one of the first side surface 112 and the second side surface 114 may include the indentation 116. The indentation 116 is disposed centrally along the first length "L1" defined by the base portion 102. Further, the indentation 116 defines a second length "L2". The second length "L2" of the indentation 116 may be approximately one third of the first length "L1". The indentation 116 may be substantially trapezoidal in shape.

The indentation 116 defines a taper surface 118 extending between the first surface 104 and the second surface 106. In the illustrated embodiment, the indentation 116 tapers from the first surface 104 of the base portion 102 towards the second surface 106 of the base portion 102. In another embodiment, the indentation 116 may taper from the second surface 106 of the base portion 102 towards the first surface 104 of the base portion 102. The taper surface 118 allows the user to switch the base portion 102 between the first position and the second position. More particularly, the taper surface 118 is adapted to engage with the foot of the user for switching the base portion 102 between the first position and the second position. For example, users may use their toes or front portion of their foot to switch the footrest device 100 between the first and second positions without lifting the footrest device 100 or leaning down. It should be noted that the footrest device 100 excludes an energy storage device. More particularly, the footrest device 100 does not include energy storage devices, such as springs or other complicated mechanisms including springs, for switching the base portion 102 between the first and second positions.

Further, the base portion 102 include a third side surface 120 and a fourth side surface 122. The pair of side surfaces 112, 114, the third side surface 120, and the fourth side surface 122 along with the first surface 104 and the second surface 106 define an integrated solid body of the footrest device 100. Further, a strap 124 is adapted to be coupled to the base portion 102. The strap 124 is used to grip the footrest device 100 by the user for handling or carrying the footrest device 100. The strap 124 provides ease in handling and shifting the footrest device 100 from one place to another. The strap 124 may be coupled to the third side surface 120 or the fourth side surface 122. In the illustrated example, the strap 124 is coupled to the third side surface 120. In other examples, each of the third and fourth side surfaces 120, 122 may include the strap 124. Further, the strap 124 may be replaced by other gripping elements such as handle, knob, shaft, stem, arm, and the like. In one example, the strap 124 includes a harness clip 126 that allows coupling of the strap 124 with an attachment portion 128 extending from the third side surface 120. The attachment portion 128 may define a groove to engage with the strap 124. However, the strap 124 may include other clamping arrangements instead of the harness clip 126. For example, buckle, clasp, clip, catch, fastener, and the like may be used to couple the strap 124 with the third or fourth side surfaces 120, 122.

Figure 2:
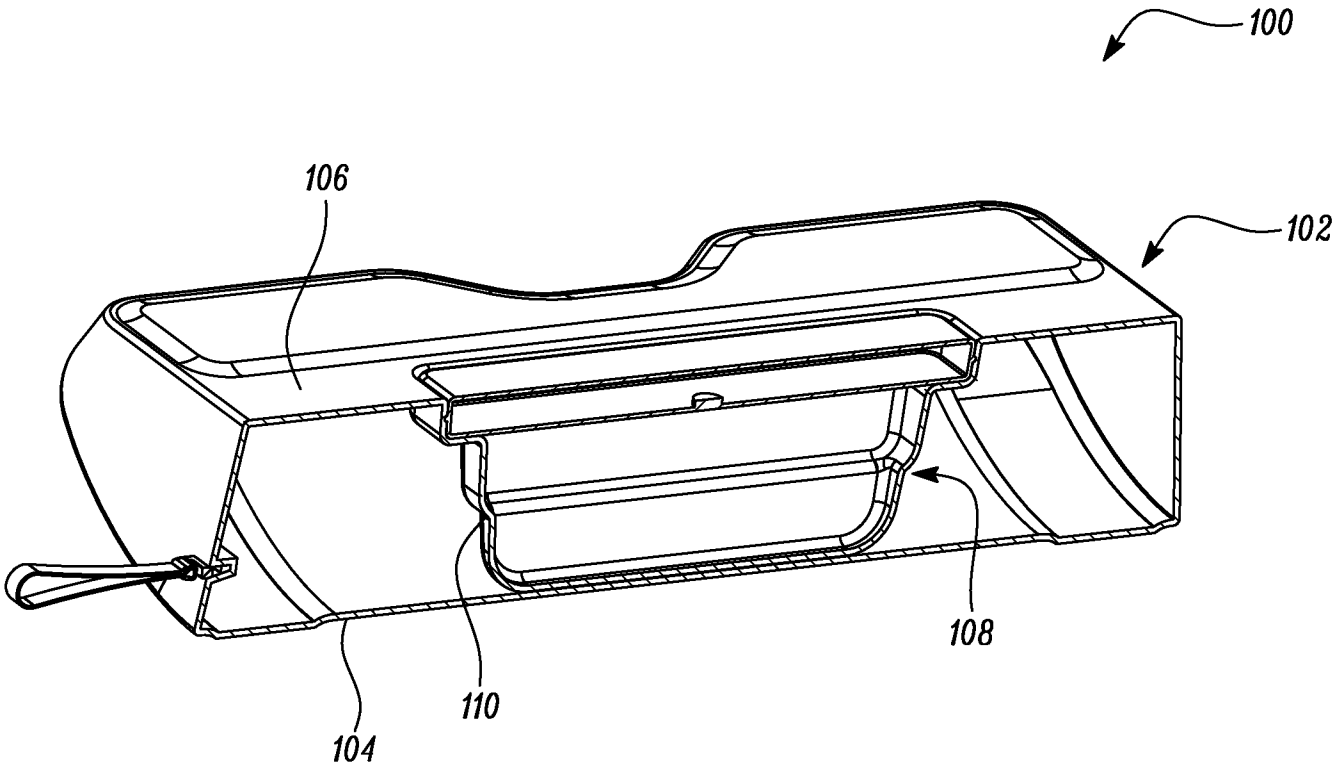
FIG. 2 is a cross-sectional view of the footrest device according to an embodiment of the present disclosure.

Referring now to FIG. 2, the footrest device 100 is generally embodied as a hollow structure. Further, the base portion 102 includes a support structure 108 extending between the first surface 104 and the second surface 106.

The support structure 108 includes a stepped design. The support structure 108 includes a generally hollow structure having a wall 110 extending between the first and second surfaces 104, 106.

Figure 3:
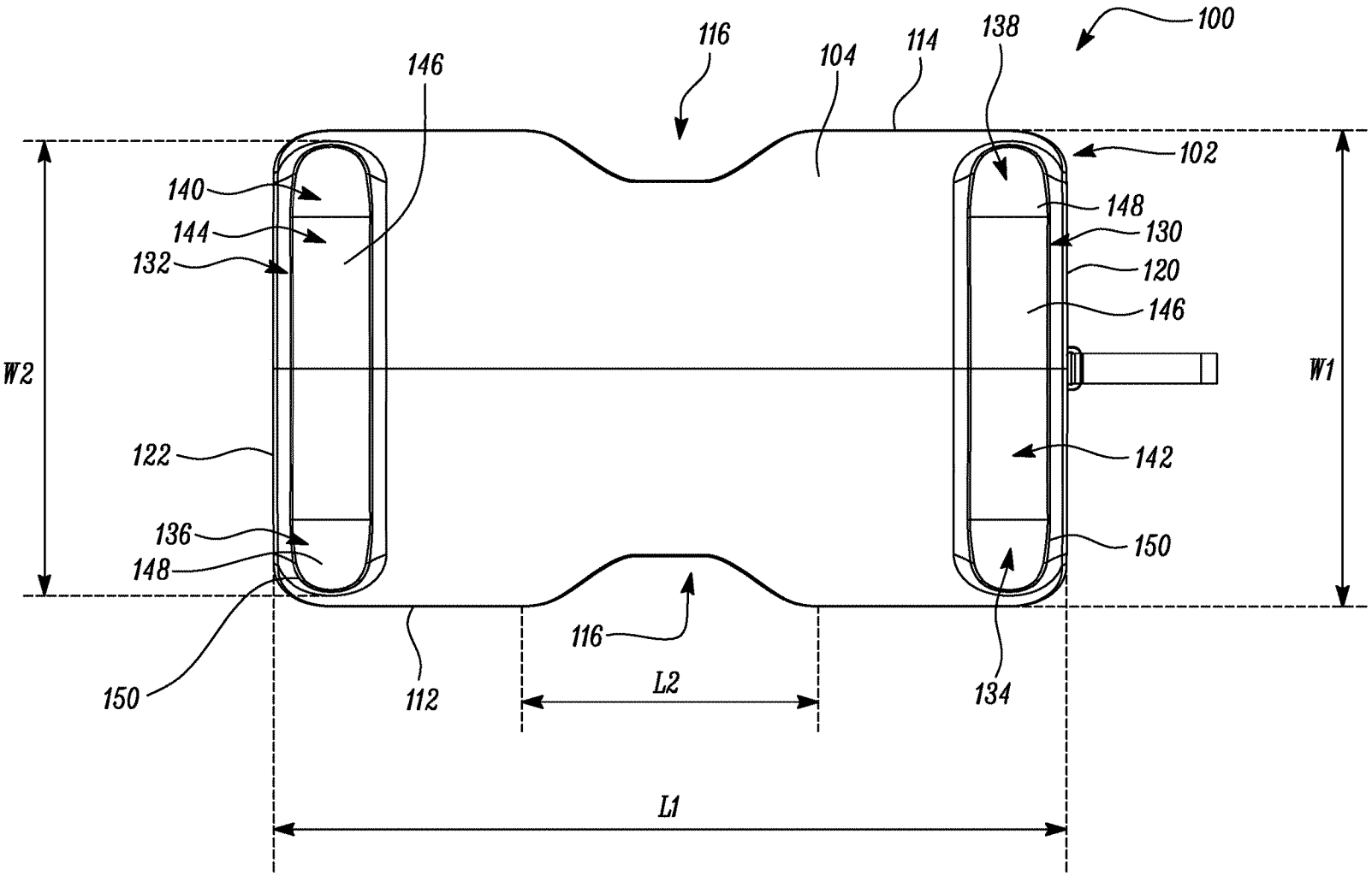
FIG. 3 illustrates a top view of the footrest device according to an embodiment of the present disclosure.

As shown in FIG. 3, the footrest device 100 also includes a first segment 130 and a second segment 132. Each of the first and second segments 130, 132 extend along the first width "W1" defined by the base portion 102. In another embodiment, the first segment 130 and the second segment 132 may be disposed such that the first and second segments 130, 132 extend along the first length "L1" of the base portion 102. Each of the first segment 130 and the second segment 132 define a second width "W2". The second width "W2" is greater than half of the first width "W1" defined by the base portion 102. However, a relation between the first width "W" and the second width "W2" may vary as per application requirements.

As illustrated, the first segment 130 is disposed proximate the third side surface 120 of the base portion 102 and the second segment 132 is disposed proximate the fourth side surface 122 of the base portion 102. Each of the first and second segments 130, 132 have identical shape and dimensions. Although the footrest device 100 described herein includes two segments 130, 132, in other embodiments, the footrest device 100 may include only one of the first and second segments 130, 132.

Further, in the illustrated example, each of the first and second segments 130, 132 is integral with the base portion 102. For example, the first segment 130 and the second segment 132 may be integrally formed with the base portion 102. In an alternate example, each of the first and second segments 130, 132 is adapted to be coupled with the base portion 102. In such an example, the first segment 130 and the second segment 132 may be manufactured as separate components that are coupled to the base portion 102 to form the footrest device 100. The first segment 130 and the second segment 132 may be coupled to the first surface 104 using mechanical fasteners such as bolts, rivets, screws, and the like. Alternatively, the first segment 130 and the second segment 132 may be coupled to the first surface 104 using adhesives or any other joining techniques known in the art.

Further, the first and second segments 130, 132 may be made from polymer, metal, ceramics, composites, and the like. In the illustrated embodiment, first segment 130, the second segment 132, and the base portion 102 are made of same material. In alternate embodiments, the first segment 130, the second segment 132, and the base portion 102 are made of different materials. The material of the first segment 130 and the second segment 132 may be selected based on durability, weight, cost, working environment, etc. Generally, the first and second segments 130, 132 are in direct contact with the floor in the second position of the footrest device 100. Thus, the first and second segments 130, 132 may be subjected to wear and tear since a weight of the footrest device 100 and a weight of user's feet may be supported by the first segment 130 and the second segment 132. Accordingly, the first and second segments 130, 132 may be manufactured of a wear resistant material to prolong usability of the footrest device 100. Further, in some examples, a flexible material may be disposed on the first and second segments 130, 132 that contacts the floor or the first and second segments 130, 132 may itself be manufactured of the flexible material.

In the illustrated embodiment, each of the first segment 130 and the second segment 132 includes at least one limit stop 134, 136, 138, 140. More particularly, in the illustrated example, the footrest device 100 is designed such that each of the first and second segments 130, 132 include the first limit stop 134, 136, the second limit stop 138, 140, and a projecting portion 142, 144 extending between the first limit stop 134, 136 and the second limit stop 138, 140. Each projecting portion 142, 144 includes a curved surface 146 (best seen in FIG. 1). A shape of the curved surface 146 is substantially similar to the shape of the first surface 104. Accordingly, the curved surface 146 of the projecting portion 142, 144 may have any profile such as circular, elliptical, parabolic, and the like. Each of the first limit stop 134, 136 and the second limit stop 138, 140 define a first thickness "T1" (see FIG. 4) and the projecting portion 142, 144 defines a second thickness "T2" (see FIG. 4), the first thickness "T1" being greater than the second thickness "T2". The second thickness "T2" may vary based on variation in the thickness "T1".

The footrest device 100 further includes the at least one limit stop 134, 136, 138, 140 projecting from the first surface 104 of the base portion 102. The at least one limit stop 134, 136, 138, 140 is adapted to restrict a range of movement of the base portion 102 when the base portion 102 is in the second position. The term "range of movement" used herein may be defined as an allowable rocking movement of the footrest device 100 along the first surface 104 of the base portion 102 when the base portion 102 is in the second position. As illustrated, the at least one limit stop 134, 136, 138, 140 is disposed proximate at least one of the pair of side surfaces 112, 114. In the illustrated embodiment, the footrest device 100 includes a plurality of limit stops 134, 136, 138, 140 projecting from the first surface 104 of the base portion 102. More particularly, the footrest device 100 includes four limit stops 134, 136, 138, 140 projecting from the first surface 104 of the base portion 102. As illustrated, the footrest device 100 includes two first limit stops 134, 136 disposed proximate the first side surface 112 and two second limit stops 138, 140 disposed proximate the second side surface 114.

In another example, the footrest device 100 may include at least one first limit stop 134, 136 disposed proximate the first side surface 112 of the pair of side surfaces 112, 114 and at least one second limit stop 138, 140 disposed proximate the second side surface 114 of the pair of side surfaces 112, 114. For example, the footrest device 100 may include the first limit stop 134 disposed proximate the first side surface 112 and the second limit stop 138 disposed proximate the second side surface 114. Alternatively, the footrest device 100 may include the first limit stop 136 disposed proximate the first side surface 112 and the second limit stop 140 disposed proximate the second side surface 114. In another example, the footrest device 100 may include the first limit stop 134 and the second limit stop 138. In yet another example, the footrest device 100 may include the first limit stop 136 and the second limit stop 140.

In the illustrated example, the first and second segments 130, 132 define the limit stops 134, 136, 138, 140. Alternatively, the footrest device 100 may eliminate the first and second segments 130, 132 and the footrest device 100 may only include the limit stops 134, 136, 138, 140 that may be embodied as tabs projecting from the first surface 104. Further, the at least one limit stop 134, 136, 138, 140 includes a planar surface 148. The planar surface 148 is adapted to contact the floor when the footrest device 100 is in the second position. The planar surface 148 of the corresponding limit stop 134, 136, 138, 140 contacts the floor in order to restrict the range of movement of the base portion 102 when the base portion 102 is in the second position. Each limit stop 134, 136, 138, 140 further includes a side portion 150 extending between the first surface 104 and the planar surface 148. The side portion 150 is substantially semicircular or semielliptical in shape, but the shape of the side portion 150 may vary as per design requirements.

Figure 4:
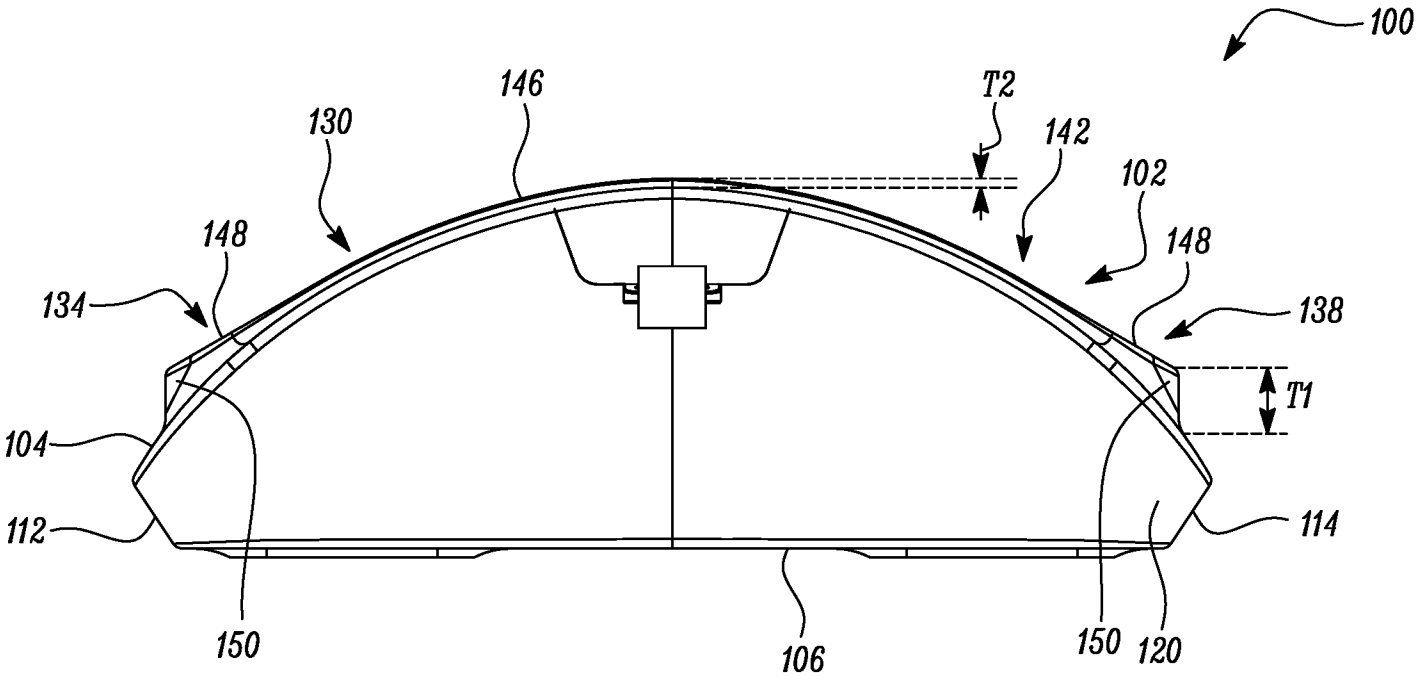
FIG. 4 illustrates a side view of the footrest device according to an embodiment of the present disclosure.

As shown in FIG. 4, each of the first limit stops 134, 136 (see FIG. 3) and the second limit stops 138, 140 (see FIG. 3) define the first thickness "T1" that is defined by a distance between the first surface 104 and the planar surface 148. In the illustrated embodiment, the curved surface 146 of the projecting portion 142, 144 (see FIG. 3) is in communication with the planar surface 148 of the corresponding limit stops 134, 136, 138, 140 such that the planar surfaces 148 and the curved surfaces 146 together allow movement of the footrest device 100 when the footrest device 100 is in the second position.

It should be noted that the range of movement may vary based on a positioning of the limit stops 134, 136, 138, 140 and dimensions of the limit stops 134, 136, 138, 140, such as the first thickness "T1". In the illustrated embodiment, the limit stops 134, 136, 138, 140 are designed to restrict the range of angular movement to a value between 25 degrees and 35 degrees. In one specific example, the limit stops 134, 136, 138, 140 may be designed to restrict the range of angular movement to 30 degrees. It should be noted that the first thickness "T1" of each limit stop 134, 136, 138, 140 may be decided based on the desired value for the range of angular movement. Accordingly, the first thickness "T1" of the limit stops 134, 136, 138, 140 may vary to provide different ranges of angular movement. For example, the first thickness "T1" may increase for a lower value of the range of angular movement and the first thickness "T1" may increase for a higher value of the range of angular movement.

Figure 5:
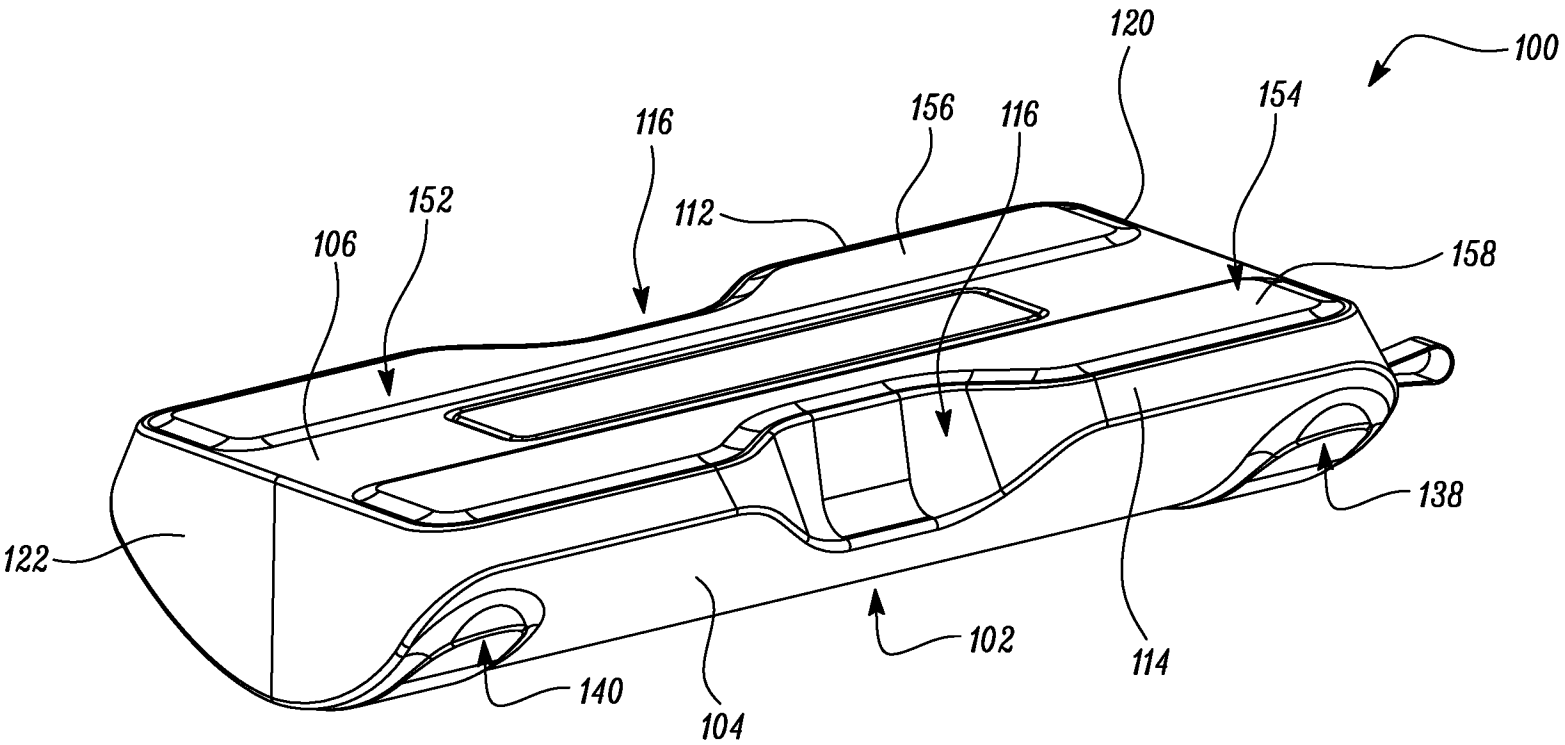
FIG. 5 is a perspective view of a footrest device in a second position according to an embodiment of the present disclosure.

As illustrated in the FIG. 5, the second surface 106 includes a pair of leg portions 152, 154 extending from the second surface 106. More particularly, the second surface 106 includes the first leg portion 152 and the second leg portion 154 extending along the first length "L1". In another embodiment, the pair of leg portions 152, 154 may extend along the first width "W1" of the base portion 102. In the illustrated example, the leg portions 152, 154 define a surface 156, 159 that is generally parallel to the second surface 106 for supporting the footrest device 100. In other examples, the leg portions 152, 154 may be embodied as a strip of material extending from the second surface 106.

In the illustrated embodiment, the pair of leg portions 152, 154 are integral with the base portion 102. The pair of leg portions 152, 154 and the base portion 102 are manufactured using the same material. In another embodiment, the pair of leg portions 152, 154 may be manufactured as separate components that are coupled to the base portion 102. In examples where the material of the pair of leg portions 152, 154 is different from the material of the base portion 102, the material of the pair of leg portions 152, 154 may be selected based on durability, weight, cost, working environment etc. As the pair of leg portions 152, 154 are in contact with the floor in the first position of the base portion 102, the leg portions 152, 154 may be subjected to wear and tear of the pair of leg portions 152, 154 since the weight of the footrest device 100 and the weight of user's feet is supported by the pair of leg portions 152, 154. Accordingly, the leg portions 152, 154 may be made of a wear resistant material or the wear resistant material may be disposed on the surface 156, 158 of the leg portions 152, 154.

In some examples, the footrest device 100 may be embodied as a single piece assembly. Alternatively, one or more components of the footrest device 100 may be individually manufactured and assembled together to form the footrest device 100, without any limitations. The footrest device 100 described herein includes fewer components and provides a simple device that allows switching of the base portion 102 between the first and second positions. Further, the footrest device 100 does not include any complicated mechanism for switching of the base portion 102 between the first and second positions thereby reducing a weight and cost associated with the footrest device 100. Thus, the footrest device 100 may provide a light weight and cost effective device.

Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

The invention claimed is:

1. A footrest device comprising:

a base portion adapted to be switched between a first position and a second position, the base portion including:

a first surface having a curved profile, wherein the first surface provides foot support to a user when the base portion is in the first position;

a second surface having a planar profile, wherein the second surface provides foot support to the user when the base portion is in the second position;

a pair of side surfaces extending between the first surface and the second surface, wherein at least one of the pair of side surfaces includes an indentation;

a first segment and a second segment disposed on the first surface of the base portion, wherein each of the first segment and the second segment extend along a first width defined by the base portion, wherein each of the first segment and the second segment include the at least one limit stop, wherein each of the first segment and the second segment include a first limit stop, a second limit stop, and a projecting portion extending between the first limit stop and the second limit stop; and at least one limit stop projecting from the first surface of the base portion, wherein the at least one limit stop is disposed proximate at least one of the pair of side surfaces.

2. The footrest device of claim 1, wherein the at least one limit stop includes a planar surface.

3. The footrest device of claim 1, wherein the at least one limit stop is adapted to restrict a range of movement of the base portion when the base portion is in the second position.

4. The footrest device of claim 1 further comprising a plurality of limit stops projecting from the first surface of the base portion.

5. The footrest device of claim 1 further comprising at least one first limit stop disposed proximate a first side surface of the pair of side surfaces and at least one second limit stop disposed proximate a second side surface of the pair of side surfaces.

6. The footrest device of claim 1, wherein the indentation is disposed centrally along a first length defined by the base portion.

7. The footrest device of claim 1, wherein each of the pair of side surfaces includes the indentation.

8. The footrest device of claim 1, wherein the indentation includes a taper surface extending between the first surface and the second surface, and wherein the taper surface is adapted to engage with a foot of the user for switching the base portion between the first position and the second position.

9. The footrest device of claim 1, wherein each of the first segment and the second segment define a second width, the second width being greater than half of the first width defined by the base portion.

10. The footrest device of claim 1, wherein each of the first limit stop and the second limit stop define a first thickness and the projecting portion defines a second thickness, the first thickness being greater than the second thickness.

11. The footrest device of claim 1, wherein the projecting portion includes a curved surface.

12. The footrest device of claim 1, wherein each of the first segment and the second segment is integral with the base portion.

13. The footrest device of claim 1, wherein each of the first segment and the second segment is adapted to be coupled with the base portion.

14. The footrest device of claim 1, wherein the first segment, the second segment, and the base portion are made of same material.

15. The footrest device of claim 1, wherein the first segment, the second segment, and the base portion are made of different materials.

16. The footrest device of claim 1, wherein the second surface includes a pair of leg portions extending from the second surface.

17. The footrest device of claim 1 further comprising a strap adapted to be coupled to the base portion.

* * * * *